US011149483B2

(12) United States Patent
Frye et al.

(10) Patent No.: US 11,149,483 B2
(45) Date of Patent: Oct. 19, 2021

(54) FURNITURE HINGE, FURNITURE PANEL, AND FURNITURE BODY

(71) Applicant: HETTICH-ONI GMBH & CO. KG, Vlotho (DE)

(72) Inventors: Stefan Frye, Ostercappeln (DE); Felix Sander, Kirchlengern (DE)

(73) Assignee: Hettich-ONI GmbH & Co. KG, Vlotho (DE)

( * ) Notice: Subject to any disclaimer, the term of this patent is extended or adjusted under 35 U.S.C. 154(b) by 5 days.

(21) Appl. No.: 16/960,975

(22) PCT Filed: Jan. 8, 2019

(86) PCT No.: PCT/EP2019/050317
§ 371 (c)(1),
(2) Date: Jul. 9, 2020

(87) PCT Pub. No.: WO2019/137898
PCT Pub. Date: Jul. 18, 2019

(65) Prior Publication Data

US 2020/0332583 A1 Oct. 22, 2020

(30) Foreign Application Priority Data

Jan. 12, 2018 (DE) ..... 10 2018 100 672.1

(51) Int. Cl.
*E05D 7/00* (2006.01)
*E05F 5/00* (2017.01)
(Continued)

(52) U.S. Cl.
CPC ..... *E05F 5/006* (2013.01); *E05D 3/122* (2013.01); *E05D 3/183* (2013.01); *E05D 5/08* (2013.01);
(Continued)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 2,626,420 A * 1/1953 Mongin ..... E05F 1/1269 16/79
2,959,808 A * 11/1960 Limberg ..... E05D 3/022 16/354
(Continued)

FOREIGN PATENT DOCUMENTS

DE 3807729 A1 9/1989
DE 202015100934 U1 5/2016
(Continued)

OTHER PUBLICATIONS

International Search Report dated Apr. 26, 2019 in related/corresponding International Application No. PCT/EP2019/050317.
(Continued)

*Primary Examiner* — Chuck Y Mah
(74) *Attorney, Agent, or Firm* — Patent Portfolio Builders PLLC

(57) ABSTRACT

A furniture hinge includes a body-side main element and a hinge cup, which is pivotally guided relative to the base element and which can be secured to a movable furniture part. The main element and the hinge cup are connected together via a lever mechanism. The furniture hinge is configured so that the lever mechanism has at least two levers, each of which is mounted on the hinge cup in a pivotal manner about a pivot axis that is aligned perpendicularly to the pivot axis of the hinge cup and each of which is provided with a toothing that meshes with another toothing arranged in the hinge cup.

18 Claims, 9 Drawing Sheets

Figure 1A:
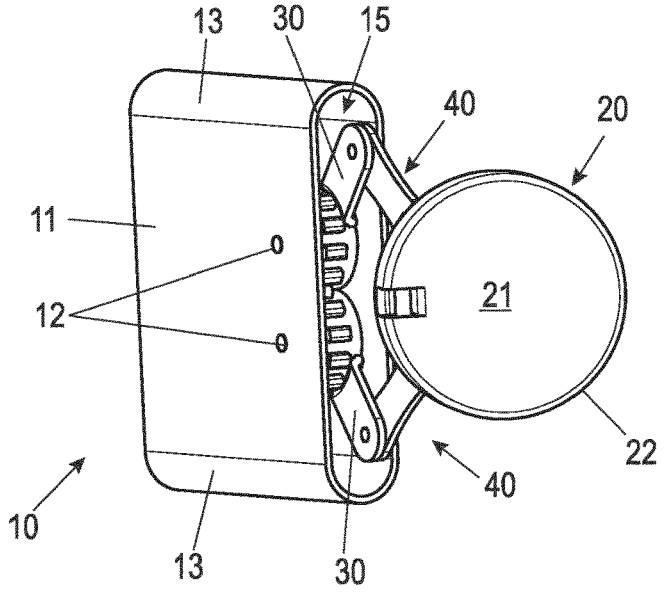

(51) Int. Cl.
*E05D 3/12* (2006.01)
*E05D 3/18* (2006.01)
*E05D 5/08* (2006.01)

(52) U.S. Cl.
CPC ... *E05Y 2201/626* (2013.01); *E05Y 2201/718* (2013.01); *E05Y 2600/41* (2013.01); *E05Y 2900/20* (2013.01)

(58) Field of Classification Search
CPC ..... E05Y 2201/21; E05Y 2201/616; E05Y 2201/718; E05Y 2600/41; E05Y 2600/45; E05F 5/006; E05F 5/02; E05F 5/027; E05F 3/20; E05D 3/142; E05D 5/0276; E05D 11/1021; E05D 11/1042; E05D 11/105; E05D 11/1064; E05D 7/04; E05D 7/0407; E05D 7/125; E05D 3/122; E05D 3/183; E05D 5/08; Y10T 16/5383; Y10T 16/304; Y10T 16/54029
See application file for complete search history.

(56) References Cited

U.S. PATENT DOCUMENTS 5,269,048 A * 12/1993 Pazmany ..... B64C 1/1407 16/354
5,991,975 A * 11/1999 Baer ..... E05D 7/009 16/250
7,127,778 B2 * 10/2006 Salice ..... E05F 5/006 16/354
7,810,212 B2 * 10/2010 Salice ..... E05D 11/1021 16/286
8,720,010 B2 * 5/2014 Forster ..... E05F 5/006 16/286
9,187,944 B2 * 11/2015 Cianetti ..... E05F 15/53
10,767,407 B2 * 9/2020 Salice ..... E05F 1/1253
2006/0236505 A1 * 10/2006 Maatta ..... H04M 1/022 16/366
2007/0094846 A1 * 5/2007 Ishida ..... E05D 15/264 16/354
2009/0071075 A1 * 3/2009 Hoffmann ..... E05D 3/18 49/260
2013/0180081 A1 * 7/2013 Salice ..... E05F 1/10 16/64
2015/0267450 A1 * 9/2015 Chiang ..... G06F 1/1681 16/354
2015/0362958 A1 * 12/2015 Shang ..... E05D 5/04 361/679.58
2016/0010374 A1 * 1/2016 Hsu ..... G06F 1/16 74/414

FOREIGN PATENT DOCUMENTS

EP 0791711 B1 5/2000
EP 2057337 A1 * 5/2009 ..... E05F 5/02
JP 2016110588 A * 6/2016
KR 20060135213 A * 12/2006 ..... E05F 5/02

OTHER PUBLICATIONS

Search Report dated May 25, 2018 in related/corresponding DE Application No. 10 2018 100 672.1.
Written Opinion dated Apr. 26, 2019 in related/corresponding International Application No. PCT/EP2019/050317.

* cited by examiner

FURNITURE HINGE, FURNITURE PANEL, AND FURNITURE BODY

BACKGROUND AND SUMMARY OF THE INVENTION

Exemplary embodiments of the invention relate to a furniture hinge comprising a body-side main element and a hinge cup, which is pivotally guided relative to the main element and which can be secured to a movable furniture part, the main element and the hinge cup being connected to one another via a lever mechanism. Exemplary embodiments of the invention further relate to a furniture panel and a furniture body comprising such a furniture hinge.

Furniture hinges are used to move movable furniture parts relative to a fixed furniture body, in particular to pivot them. Furniture such as kitchen furniture often has multiple doors arranged side by side. When opening a furniture door arranged in this way, the door must not collide with the adjacent doors, even if the gap between the doors is small. In principle, this can be achieved by means of an external single-joint hinge. More frequently, a multiple-joint hinge, which is not visible from the outside, is used, which is placed on the inside of a side panel of the body with the aid of a mounting plate and supports the door with a mounting element which is movable relative thereto. Hinge cups that can be recessed into the material of the door have become established as mounting elements.

The required course of movement of the hinge cup relative to the main element in a multi-joint hinge is usually achieved by means of a lever mechanism having a number of levers connected to each other in an articulated manner. As an alternative to this, document EP 0 791 711 B1 describes a wide-angle hinge in which at least one of the articulated levers is rotatably mounted eccentrically on a gear, which is in meshing engagement with a toothed rack. The toothed rack and the gear engaging in it are arranged in the main body of the hinge. In this way, the lever can be moved axially out of the main body, which allows a particularly large opening angle of the hinge to be achieved.

In order to ensure that the furniture body has an elegant appearance even when the cabinet door is open, hinges are also known in which the main body is so narrow in at least one direction that it can be inserted into a milled pocket in a construction panel of the furniture carcass. An example is described in document DE 20 2015 100 934 U1. In the case of this hinge, a pivot arm extends from the main body and supports the movable furniture part. The main body is case-like and extends in a horizontal plane. Consequently, it cannot be inserted in a side panel of the furniture body, but only in a top or bottom panel. Accordingly, only two hinges arranged in the area of the corners of the body can be used for a door. However, high doors often require more than the two hinges mentioned above in order to be guided properly, due to their weight and otherwise inadequate stability.

Exemplary embodiments of the present invention are directed to a furniture hinge of the kind described at the outset, the main body of which, due to its design, can be made so flat that it can be inserted into a side panel of a furniture body. The course of movement of a furniture door guided by the furniture hinge shall be such that further doors with a small gap in-between can be connected to the door in question.

A furniture hinge according to the invention of the type described at the outset is configured in a manner that the lever mechanism comprises at least two pivotable levers, each of which is mounted on the hinge cup in a pivotal manner about an axis that is oriented perpendicularly to a pivot axis of the hinge cup and each of which is provided with a toothing that engages with a further toothing arranged in the hinge cup.

The toothings of the lever and hinge cup engaging with one another are designed so that a pivoting movement of the hinge cup when moving the connected furniture part, i.e., for example a furniture door, leads to a pivoting movement of the lever, which easily can be converted into a linear movement. This means that a pivoting movement of the hinge cup and thus of the furniture door is accompanied by a linear movement. The combined linear and pivoting movement of the hinge cup allows the hinge cup to be used for adjacent furniture doors with a small gap in-between, since the guided furniture door is lifted off the body when it is opened and is thus positioned in front of the adjacent door when it is swung open to such an extent that its edge moves beyond the surface of the adjacent door.

The design of the lever mechanism with horizontally arranged joint axes results in a laterally very slim construction, which can be arranged accordingly in a flat main element. None of the levers pivot about a vertical pivot axis, which would result in an increased spatial requirement in the lateral direction.

In an advantageous embodiment of the furniture hinge, the toothing of each lever is formed by a bevel gear, which is arranged on the pivot axis of the lever. The bevel gears can be very flat and also allow an angular arrangement of different pivot axes relative to each other. The toothing in the hinge cup is likewise formed correspondingly in the manner of a bevel gear, for example as a segment of a bevel gear.

In a further advantageous embodiment of the furniture hinge, the pivot axis of each lever is in turn mounted pivotally on the hinge cup. In this way, the hinge cup can be pivoted during the opening and closing movement. The pivot axes of the at least two levers can, for example, be formed by the legs of a U-shaped bearing bracket, which is preferably secured rotatably to the hinge cup via a base in an area between the two legs.

In a further advantageous embodiment of the furniture hinge, the at least two levers are coupled via the toothings in such a way that they execute a mirror-image synchronous pivoting movement. In this way a stable guidance is achieved. The lever mechanism preferably has at least two further levers that are hinged pivotally to the main element, preferably mounted about a pivot axis oriented perpendicularly to the pivot axis of the hinge cup. The at least two further levers can each also be provided with a toothing and engage in each other in such a way that they perform a mirror-image synchronous pivoting movement. This toothing is preferably formed by a cylindrical gear, which is arranged on the pivot axis of the further lever.

It is further preferred that in each case one lever and one further lever are articulated to one another at ends, a distance between the pivot axes of the at least two further levers being equal to a distance between the pivot axes of the at least two levers. In this way a linear guide based on pivoting movements is realized, which can be constructed in a particularly space-saving manner.

In a further advantageous embodiment of the furniture hinge, the hinge has a damping device for damping a closing and/or opening movement, the damping device being designed as a linear damper or rotary damper. Preferably, the damping device is at least temporarily coupled to at least one lever of the lever mechanism or is at least temporarily connected to a toothing of at least one lever of the lever mechanism and/or of the hinge cup in order to achieve a braking of the opening and/or closing movement.

A furniture panel of the invention with an integrated or inserted furniture hinge of the type described above is configured so that the pivot axes of the lever mechanism and the pivot axes of the hinge cup lie between two parallel planes of the furniture panel over the entire range of movement of the movable furniture part, the distance between the planes corresponding to the width of an end face of the furniture panel. In this way, the lever mechanism of the hinge can fully retract into a recess in the furniture panel in which the main body of the furniture hinge is inserted. This additionally ensures that a door guided by the furniture hinge does not collide with an adjacent door or furniture front.

A furniture body according to the invention has a furniture panel of this kind with an integrated or inserted furniture hinge of the type described above. This results in the advantages mentioned in conjunction with the furniture panel and the furniture hinge.

BRIEF DESCRIPTION OF THE DRAWING FIGURES

Figure 1B:
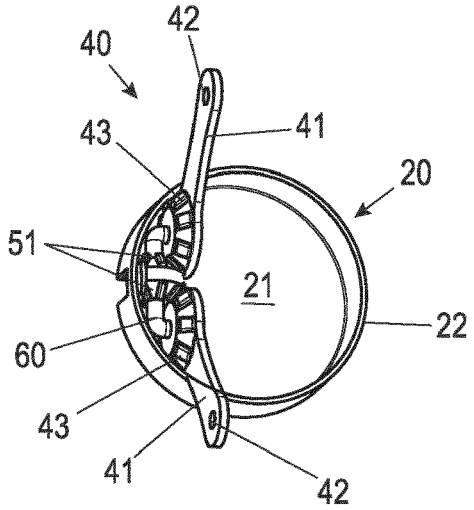
Figure 1C:
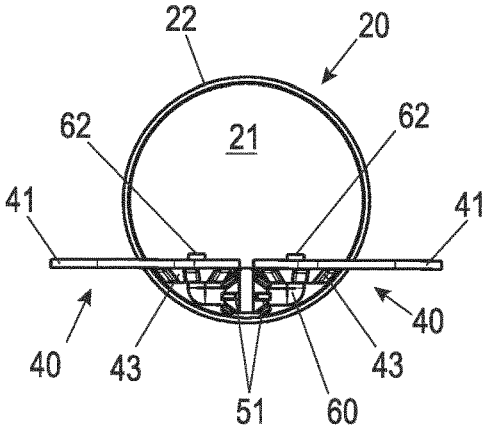

The invention will be explained in greater detail below with the help of drawings, in which:

FIG. 1*a* shows an isometric overall view of a furniture hinge according to the application;

FIG. 1*b*, 1*c* show two different views of a part of the hinge according to FIG. 1*a;*

Figure 2A:
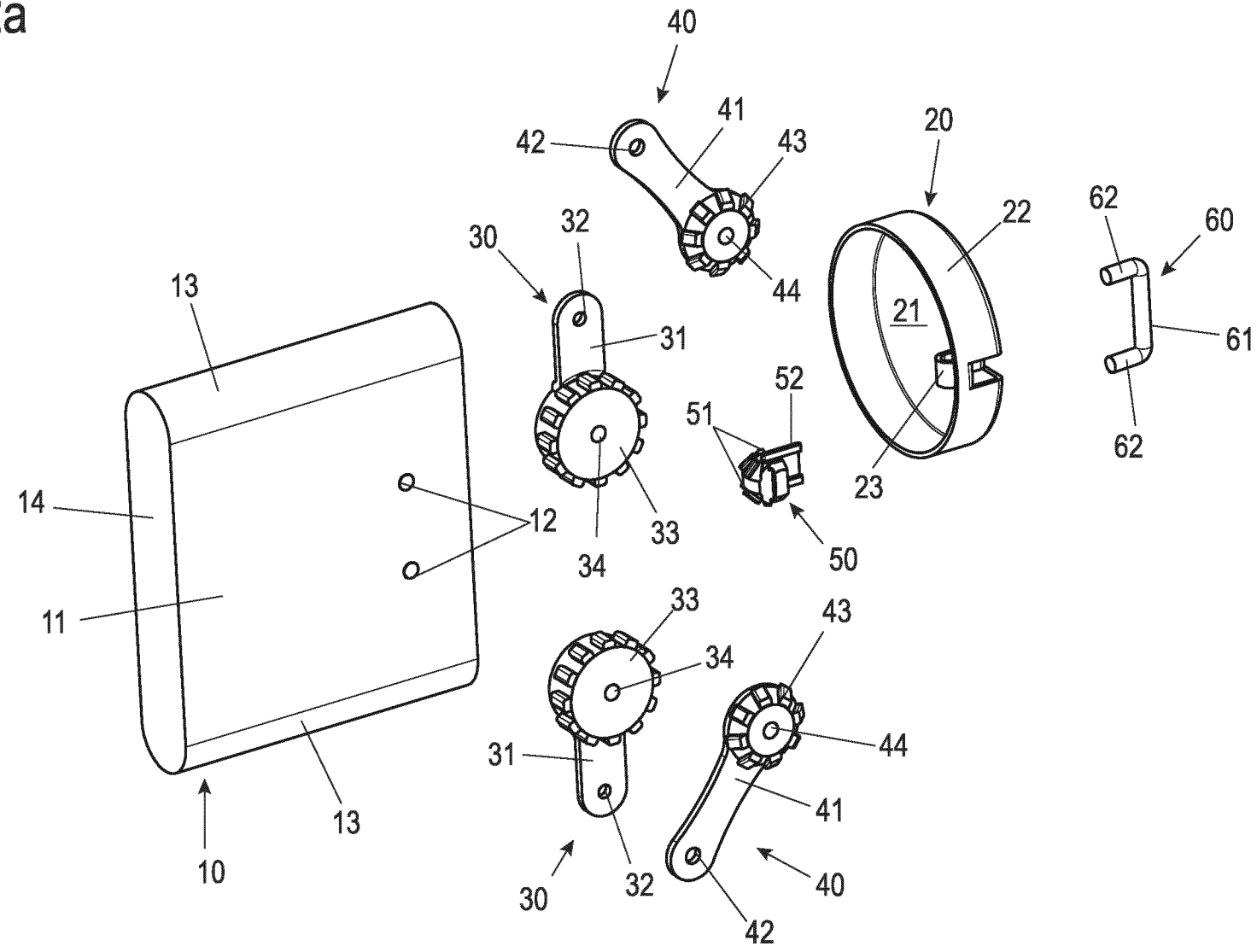
Figure 2B:
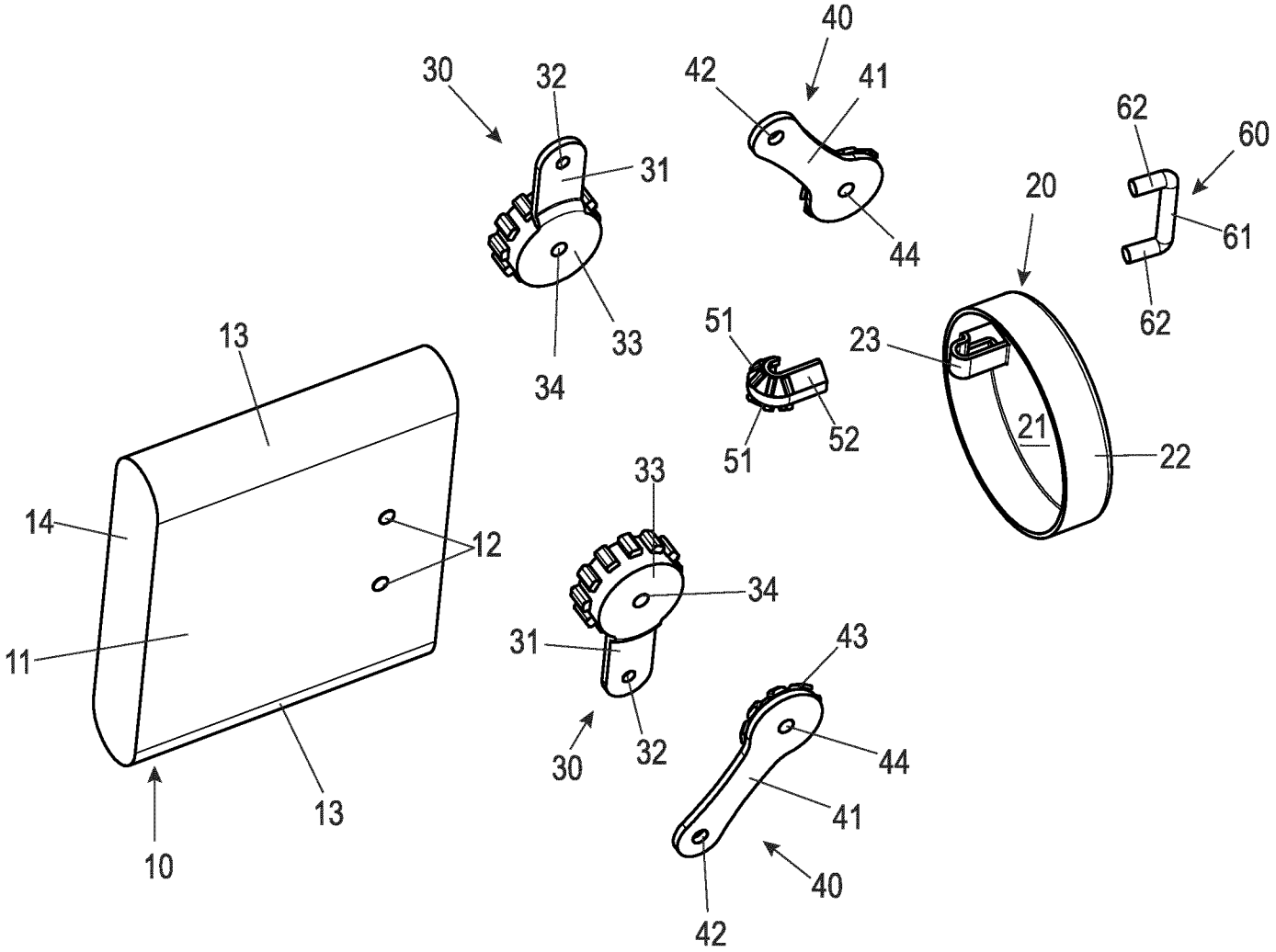
Figure 3A:
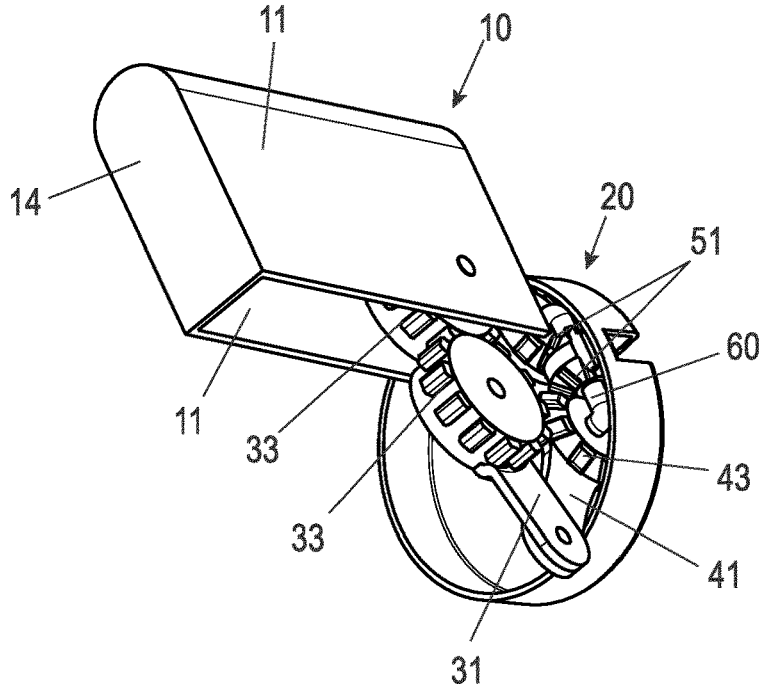
Figure 3B:
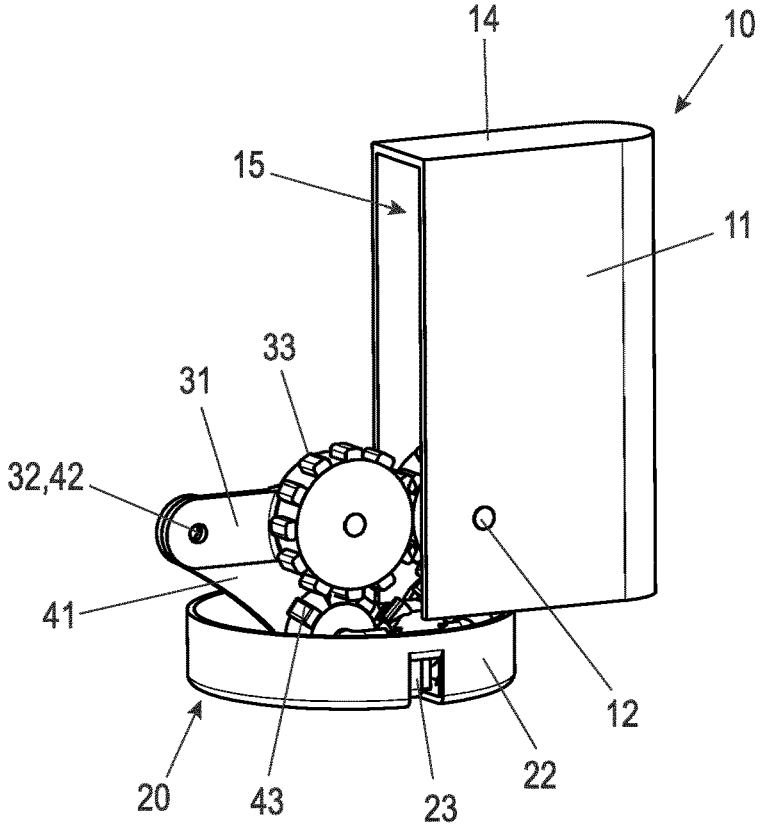
Figure 4A:
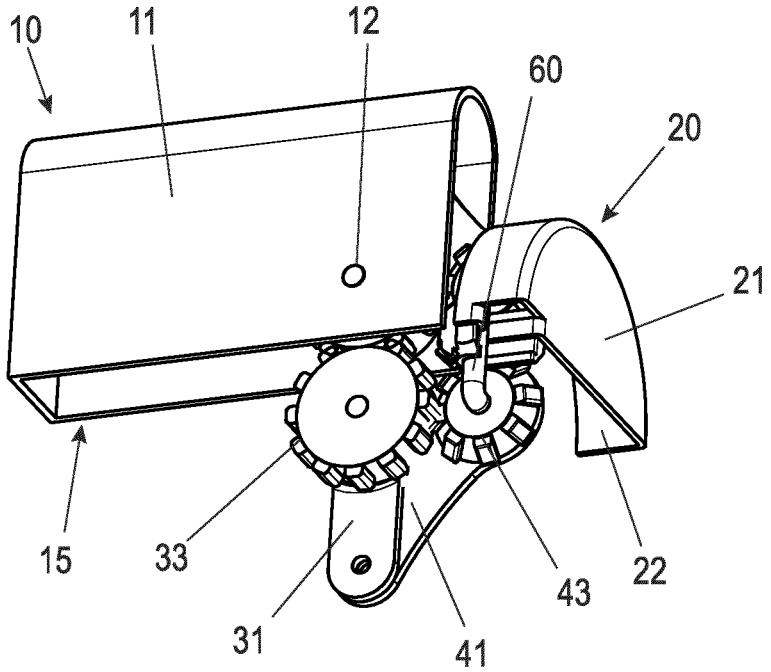
Figure 4B:
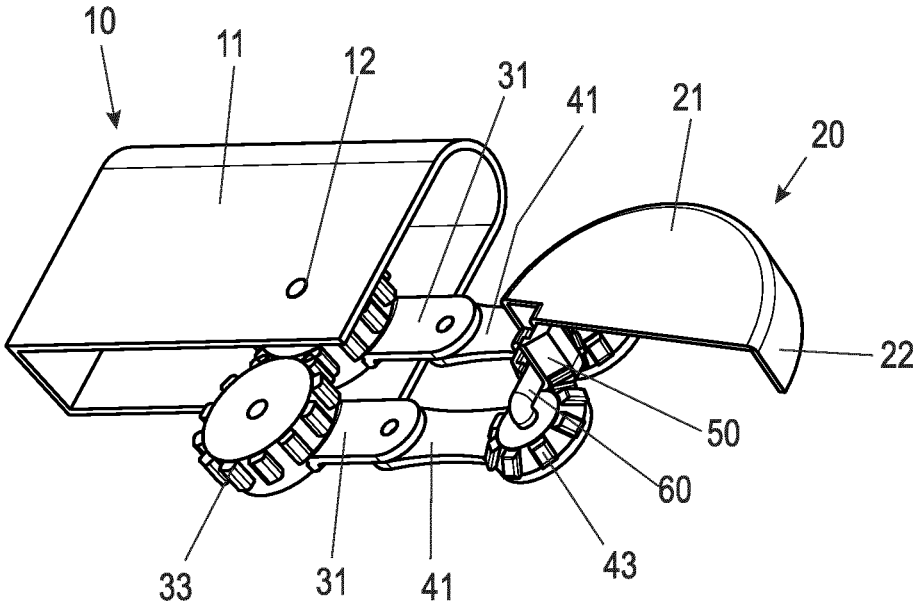
Figure 5A:
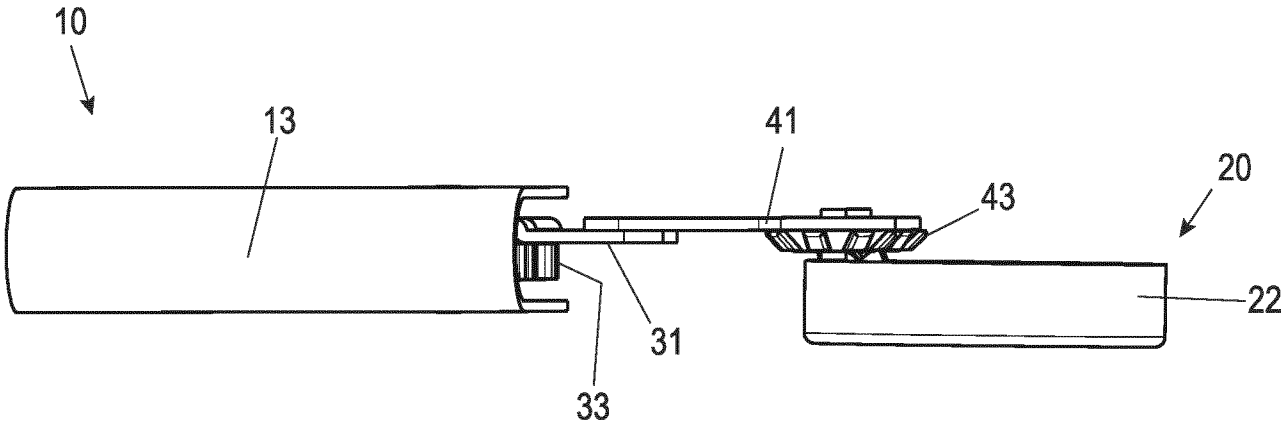
Figure 5B:
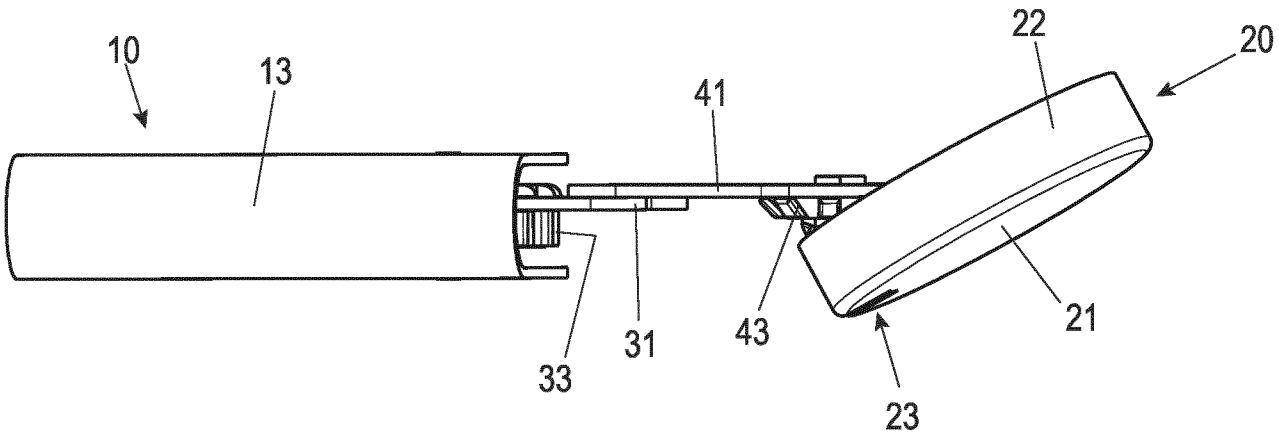
Figure 6:
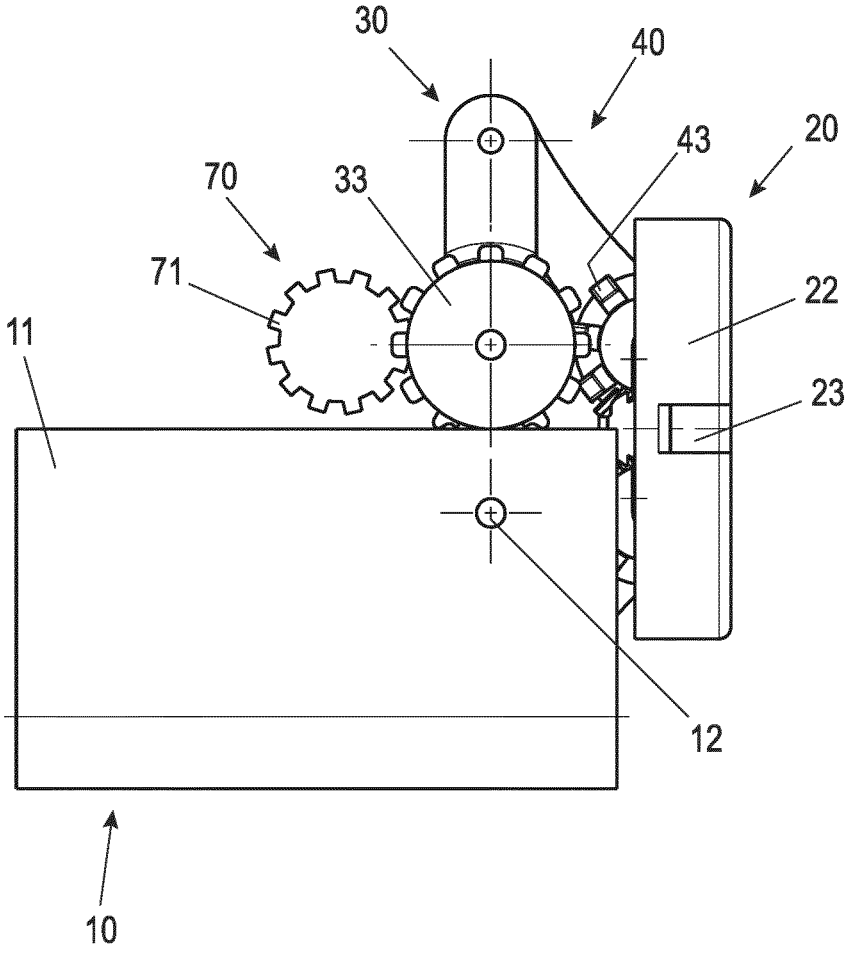
Figure 7A:
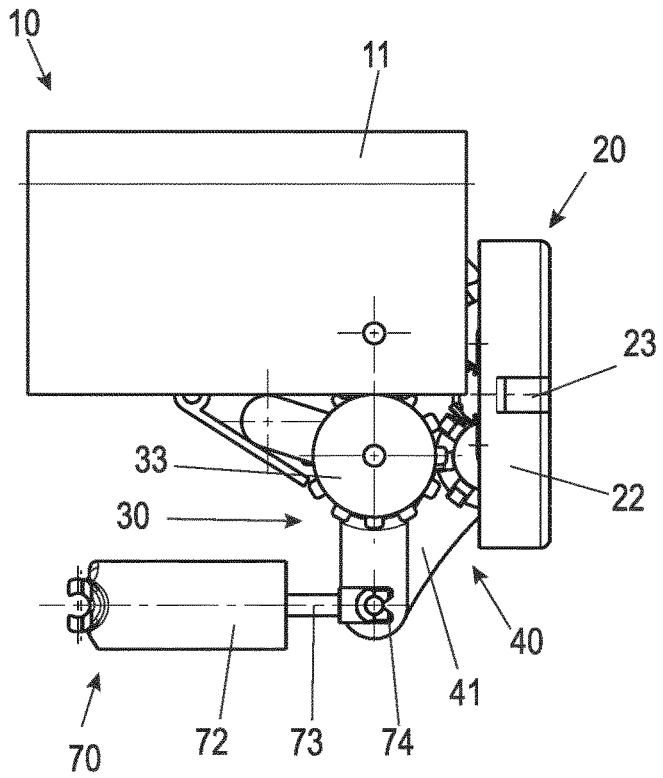
Figure 7B:
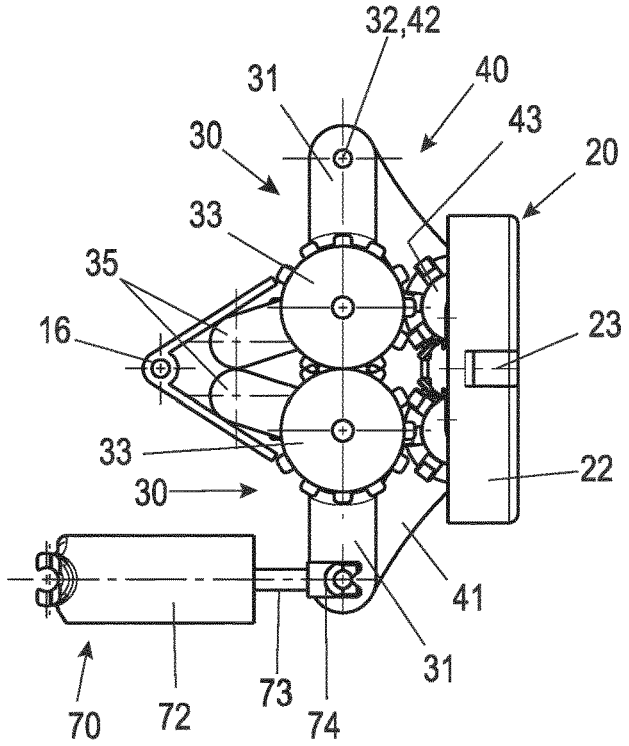
Figure 8:
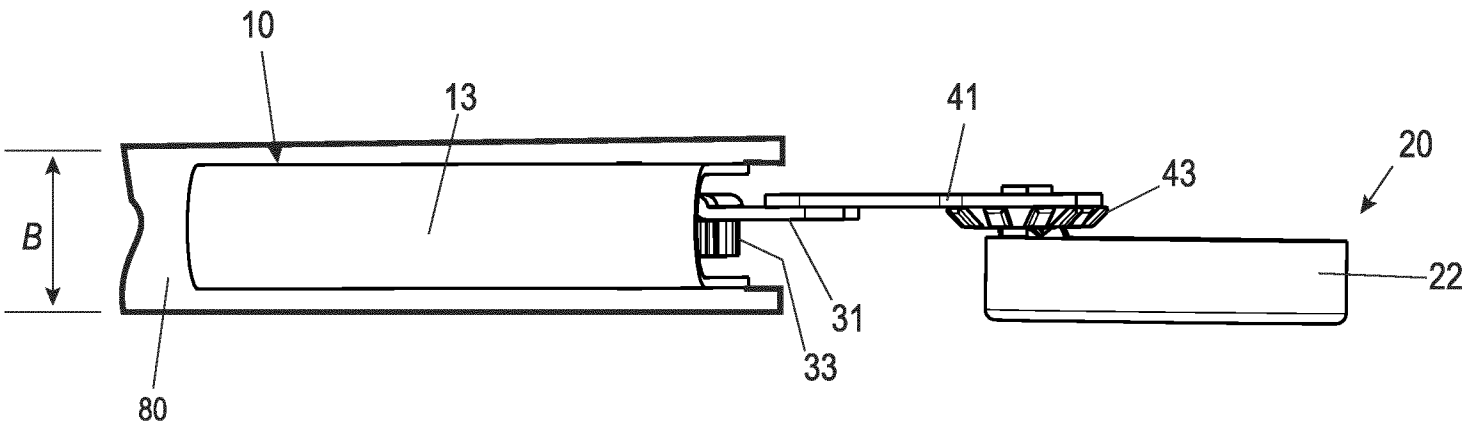

FIG. 2*a*, 2*b* show an isometric exploded view of the hinge according to FIG. 1*a* from different viewing directions;

FIG. 3*a*, 3*b* show two different isometric views of the hinge according to FIG. 1*a*, with part of the main element removed in each case;

FIG. 4*a*, 4*b* show two different isometric views of the hinge according to FIG. 1*a*, with part of the main element and part of the hinge cup removed in each case;

FIG. 5*a*, 5*b* show a side view of the hinge in different opening positions;

FIG. 6 show a side view of a modification of the hinge according to FIG. 1*a* with main element shown partially open;

FIG. 7*a*, 7*b* show a side view of a further modification of the hinge according to FIG. 1*a* with partially open (FIG. 7*a*) and completely removed (FIG. 7*b*) main element; and FIG. 8 shows a plan view of a hinge integrated in a furniture panel according to FIG. 1*a*.

The drawings show exemplary embodiments of a furniture hinge according to the invention in various presentations. In all drawings, like reference signs denote like elements. For reasons of clarity, not every element is denoted by a reference sign in all of the drawings.

DETAILED DESCRIPTION

FIG. 1*a* first shows an isometric view of an exemplary embodiment of a furniture hinge in an assembled state in a middle open position. A middle open position in the present context means that a furniture part guided by the furniture hinge, in particular a furniture door, is in an angular range lying between a closed state, in which the door rests via its free edge against the furniture body, and an open position, in which the door has an opening angle of, for example, 90° compared to the closed position.

The furniture hinge has a main element 10, which is connected to a hinge cup 20 via a lever mechanism. The lever mechanism comprises two levers 40 hinged to the hinge cup 20 and two further levers 30 hinged to the main element 10.

The main element 10 is approximately cuboidal or case-like and has two parallel side plates 11, which are connected at their side edges by rounded transverse sides 13. When the furniture hinge is installed, these transverse sides 13 are at the top and bottom. In the installed position to the front (in FIG. 1*a* towards the right side), the main element 10 is open, whereas towards the rear side (not visible in FIG. 1) a rear side 14 preferably closes the main element 10. This rear side 14 is clearly visible, for example, in FIGS. 2*a* and 2*b*, which show isometric exploded drawings of the furniture unit.

The case-like main element 10 provides a cavity 15 in which a part of the hinge mechanism (explained below) is situated. The side plates 11 are preferably spaced only so far apart that the main element 10 can be inserted into a pocket-shaped recess milled in an end face of a side panel of a furniture body. The pocket, which is preferably milled in from the end face, has a shape that corresponds to the outer contours of the main element 10 due to the milling tool used. This main element 10 can thus be inserted flush and thus well anchored on all sides into the side panel of the furniture body and can be fixed there, for example with adhesive and/or with the aid of screws, which are screwed through the rear side 14 into the material of the side panel of the furniture body. The main element 10 can, for example, be manufactured from appropriately punched sheet metal in a rolled form.

In both side plates 11 of the main element 10, holes 12 are arranged in the front middle area, which accommodate a bearing bolt (not shown here) and thus serve as bearing points. The bearing pins pass through the two further levers 30, which are thus mounted in the main element 10 so that they can rotate about a horizontal axis (in the installed position of the furniture hinge).

The further levers 30 are clearly visible in FIGS. 2*a* and 2*b*. They each comprise a lever arm 31, which has a joint bore 32 at one free end. At the opposite end, a gear 33 is non-rotatably coupled to the lever arm 31. In the shown exemplary embodiment, the lever 31 is slightly offset and enlarged in plate-like form at its free end. The gear 33 is mounted on this plate. It should be noted that in alternative embodiments, a toothing provided in the present case by the gear 33 can also be formed integrally with the lever arm 31. A further joint bore 34 runs centrally through the gear 33.

By means of these further joint bores 34, the further levers 30 are mounted pivotally on the bearing bolts, which are guided through the side plates 11. Here, the distance between the bores 12 in the side plates 11 is selected so that the two gears 33 of the further levers engage in each other, the further levers 30 performing a coordinated pivoting movement in a mirror image with respect to a central axis of the main element 10.

The free ends of the further levers 30 are coupled in the other joint bores 32 to comparable free ends of the levers 40. These levers 40 are supported at their further end in the hinge cup 20.

The arrangement and bearing of the levers 40 in the hinge cup 20 can be clearly seen in FIGS. 1*b* and 1*c*, which show an isometric view and a top view, respectively, of the hinge cup 20 with inserted levers 40 separately from the main element 10 and the further levers 30. The hinge cup 20 has a base 21 and a rim 22 and is inserted in the known manner into a cup hole in the furniture door to be guided. The hinge cup can be glued there, or fastening elements can be formed along the edge 22 by which the hinge cup 20 is clamped, latched and/or interlocked in the cup hole.

The design of the levers 40 is again shown clearly in FIGS. 2*a* and 2*b*. They are constructed similarly to the further levers 30 and have a lever arm 41 with a joint bore 42 at one end and a toothing at the opposite end. The toothing is formed here by a mounted bevel gear 43. A further joint bore 44 leads again centrally through the bevel gear 43.

In the hinge cup 20 the two levers 40 are rotatably mounted by being placed with their further joint bores on legs 62 of a bearing bracket 60. The bearing bracket 60 is in turn fixed in the hinge cup 20 via a base 61 so that it can pivot about this base 61. For this purpose, a bracket fastener 23 is formed at one point on the edge 22, into which fastener the bearing bracket 60 is inserted. The two legs 62 of the bearing bracket 60 thus form pivoting axes, about which the levers 40 can be pivoted. When the furniture hinge is in the closed position, the orientation of the legs 62 and thus of the bearing or pivot axes of the levers 40 is parallel to the base 21 of the hinge cup.

In the exemplary embodiment shown, the hinge cup 20 is formed from a metal sheet in a punching and bending process. The bracket fastener 23 can easily be punched out from the edge 22 and shaped inwardly. The hinge cup 20 is thus formed in one piece inclusive of the bracket fastener 23. In alternative embodiments, the hinge cup 20 can also be made of plastic in an injection molding process, preferably also in one piece.

The hinge cup 20 has a toothing 51 in the region of the bracket fastener 23, which toothing is in engagement with the bevel gears 43 of both second levers 40. In the exemplary embodiment shown, the toothing 51 is provided by a toothed insert 50, which again is clearly visible in FIGS. 2*a* and 2*b*. The toothing 51 has two portions of a bevel gear facing away from each other and an insertion lug 52 in-between, which is inserted into a corresponding recess in the region of the bracket fastener 23 and fixes the toothed insert 50 to the hinge cup 20. In an exemplary embodiment of the hinge cup 20 in which it is manufactured as an injection-molded part, the toothing 51 can also be formed directly on the hinge cup 20.

The two levers 40 are coupled to each other via the toothing 51 of the toothed insert 50 in such a way that, similarly to the further levers 30, they can only perform synchronous pivoting movements in a mirror image with respect to a perpendicular center plane. During this pivoting movement, the bevel gears 43 roll over the toothing 51, causing the hinge cup 20 to pivot about the base 61 of the bearing bracket 60 relative to the plane in which the levers 40 are situated.

In the assembled state of the furniture hinge, the free ends of the further levers 30 and of the levers 40, which free ends are opposite the toothed ends, are connected in pairs. For this purpose, bearing bolts or rivets are guided through the joint bores 32 and 42.

The course of movement of the furniture hinge will be explained in greater detail below with reference to FIGS. 3*a*, 3*b*, 4*a*, 4*b*, 5*a* and 5*b*.

FIGS. 3*a* and 3*b* show the assembled furniture hinge in two iso-metric presentations from different viewing directions, with only half of the main element 10 being shown for a better overview.

In FIGS. 3*a* and 3*b*, the furniture hinge is initially in the closed state, i.e., with the furniture door shut. In this state the hinge cup 20 rests with its edge 22 against the main element 10. The further levers 30 are fully pivoted into the cavity 15 of the main element.

FIG. 4*a* likewise shows the closed state of the furniture hinge, wherein in this presentation the hinge cup 20 is additionally shown cut in half.

Opening the furniture door, i.e., pivoting the hinge cup 20, causes the toothing 51 of the hinge cup 20 to roll over the bevel gears 43, whereupon the levers 40 pivot towards each other from the position shown in FIG. 4*a*. Due to the connection of the further levers 30 to the levers 40, this pivoting of the levers 40 towards each other is accompanied by a synchronous pivoting of the further levers 30 towards each other. This in turn kinematically causes an extension of the lever mechanism, with the bearing bracket 60 and thus the hinge cup 20 moving linearly away from the main element 10.

FIG. 4*b* shows the opening state of the furniture hinge, for example with an opening angle of 90° compared to the closed position. In this state, the further levers 30 connected to one another and the lever 40 form a stretched arrangement in pairs, and, correspondingly, the hinge cup 20 and the furniture door it holds are moved linearly from the side panel of the body towards the room.

The furniture hinge shown thus performs a combined pivoting movement of the hinge cup 20 with a linear movement. The linear movement causes the corresponding furniture door to move in such a way that its side edge moves in front of the front side of an adjacent furniture door as seen from the user's line of sight, so that the two doors do not collide when opened.

FIGS. 5*a* and 5*b* show the furniture hinge in a side view looking at the transverse sides 13 of the main element 10. FIG. 5*a* shows the open position of the furniture hinge, and FIG. 5*b* shows a slightly closed position, in which the hinge cup 20 is tilted and minimally retracted.

Due to the lever kinematics, the linear and pivoting movements of the hinge cup 20 are not linear to each other. Starting from the open position, in which the lever mechanism is extended, a pivoting movement of the hinge cup 20 initially leads to a small linear movement. As the closed position is approached, the linear movement increases based on a change in angle. This results in an approximately sinusoidal function relationship. This is advantageous because, conversely, starting from the closed position, an initially smaller pivoting movement of the hinge cup 20 leads already to a significant outward movement of the furniture door, so that, with the continued pivoting movement of the hinge cup 20, the furniture door is already moved outwards far enough so that it does not collide with the adjacent furniture door.

In the exemplary embodiment shown, both the levers 40 and the further levers 30 are coupled to each other by the toothings in such a way that they perform the same pivoting movements in mirror image. It should be noted that in an alternative embodiment the coupling of the two further levers 30 by the gears 33 can also be omitted.

FIGS. 6 and 7*a, b* show two further exemplary embodiment of a furniture hinge according to the invention in a side view. In these drawings, like reference signs denote like or similar elements as compared to the previous drawings.

In its basic construction, the hinges shown in FIGS. 6 and 7*a, b* correspond to the example shown in FIGS. 1*a* to 5*b*. Explicit reference is hereby made to the corresponding description.

The hinges shown in FIGS. 6 and 7*a, b* each represent a refinement of the hinge from the previous example. Specifically, the hinge of the previous example is supplemented by a damping and/or self-closing function.

In the example in FIG. 6, a damping device 70 is provided for this purpose, which is designed as a rotary damper. The damping device 70 has a circumferential gear rim 71, which engages in the gear 33 of one of the further levers 30. When the hinge pivots out, the further lever 30 pivots, whereby the (rotary) damper is rotated and damps the pivoting movement. The damper can be constructed in such a way that only specific portions of the rotary movement are damped, so that the hinge is damped when approaching the closed and/or fully open end position. Furthermore, the damper can be combined with a spring, for example a coil spring, so that the further lever 30 is preloaded in a pivoting direction, for example in the direction of the closed end position of the hinge cup 20. A combined self-closing and damping function can thus be implemented.

Since the movement of both further levers 30 is coupled in the furniture hinge shown, it is in principle sufficient to provide such a damping device 70, which engages the gear 33 of the one further lever 30. However, it would also be possible to provide two such damping devices 70 to increase the damping forces.

FIGS. 7*a* and 7*b* show a further exemplary embodiment with a damping device 70. In the example in FIG. 7*a*, similarly to the example in FIG. 6, only half of the main element 10 is shown, whereas in the exemplary embodiment in FIG. 7*b* it is completely removed in order to show the inner structure of the hinge.

In contrast to the exemplary embodiment in FIG. 6, the damping device 70 is formed here by a linear damper comprising a cylinder 72 with a piston and a piston rod 73. At the end of the piston rod there is arranged a clevis 74, via which the piston rod 73 is coupled to the lever mechanism of the hinge. The cylinder 72 of the damping device 70 is pivotally mounted on the main element 10, for example by means of a bolt or rivet which passes through the side plates 11 of the main element 10.

In the example shown, the clevis 47 acts on the connection of the lever arms 31 and 41 of the further lever 30 or lever 40 and thus damps a pivoting movement of these lever arms 31, 41. In alternative embodiments, it is conceivable that the clevis 74 acts on the lever arm 31 at other points. The damping device 70 damps a pivoting movement of the further lever 30 as the closed end position of the hinge is approached.

The exemplary embodiment in FIGS. 7*a* and 7*b* also includes a self-retracting function which, unlike in the example in FIG. 6, is not integrated in the damping device 70, but in the further levers 30. In this case, both further levers 30 are provided with a retracting spring. However, it would also be conceivable to have a retracting spring act on only one of the further levers 30. The springs themselves cannot be seen in FIG. 7*a*, 7*b*; they are arranged, for example, as coil springs below the gears 33. The ends of the springs, which are supported on the main element 10, are shown as tongues 35 in the drawings. A retaining bracket 16, which is secured to one or both side plates 11, fixes the tongues 35 in the position shown. It is also possible to make the retaining bracket 16 resilient so that it forms a retraction spring which acts on the two further levers 30 by pressing the ends of the two further levers 30 towards each other.

In this example, too, two damping devices 70 can be provided to achieve greater damping forces, which then act independently of one another on one of the further levers 30 each.

FIG. 8 shows a side view of a furniture hinge according to the application inserted into a furniture panel 80. The furniture panel 80 is shown in a sectional view in order to show the arrangement of the main element 10 within the furniture panel 80.

The main element 10 is preferably inserted with an accurate fit in a recess in the furniture panel 80, which is formed, for example milled, in the furniture panel 80, for example from one end face thereof. The main element 10 can then be glued for example into the recess, or fixed in some other way, for example with the aid of screws that are screwed into a core of the furniture panel 80 through the rear side 14 of the main element 10. The furniture panel 80 has a width B that might only exceed the thickness of the main element 10 by a few millimeters.

Throughout the course of movement of the furniture hinge during an opening and/or closing movement, the pivot axes of the levers 30, 40 of the hinge and also the pivot axes situated inside the hinge cup 20 are positioned between the planes defined by the outer upper sides of the furniture panel 80.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

REFERENCE SIGNS

10 main element
11 side plate
12 bore (bearing position)
13 transverse side
14 rear side
15 cavity
20 hinge cup
21 base
22 edge
23 bracket fastener
30 further lever
31 lever arm
32 joint bore
33 gear
34 joint bore
40 levers
41 lever arm
42 joint bore
43 bevel gear
44 further joint bore
50 toothed insert
51 toothing
52 insert tab
60 bearing bracket

61 base
62 leg
70 damping device
71 gear rim
72 cylinder
73 piston rod
74 clevis
88 furniture panel
B width

The invention claimed is:

1. A furniture hinge, comprising:
a body-side main element; and
a hinge cup, which is pivotally guided relative to the main element and which is securable to a movable furniture part,
wherein the body-side main element and the hinge cup are connected to one another via a lever mechanism,
wherein the lever mechanism comprises at least two levers, each of which is mounted on the hinge cup in a pivotal manner about a pivot axis that is oriented perpendicularly to a pivot axis of the hinge cup and each of which includes a toothing that engages with a further toothing arranged in the hinge cup.

2. The furniture hinge of claim 1, wherein the toothing of each lever is formed by a bevel gear, which is arranged on the pivot axis of the lever.

3. The furniture hinge of claim 2, wherein the further toothing forms at least one segment of a bevel gear.

4. The furniture hinge of claim 1, wherein the pivot axis of each of the at least two levers is pivotally mounted on the hinge cup.

5. The furniture hinge of claim 4, wherein the pivot axes of at least two levers are formed by two legs of a U-shaped bearing bracket.

6. The furniture hinge according to claim 5, wherein the U-shaped bearing bracket is rotatably secured to the hinge cup via a base in a region between the two legs.

7. The furniture hinge of claim 1, wherein the at least two levers are coupled to each other via the toothings of the at least two levers in such a way that the at least two levers perform a mirror-image synchronous pivoting movement.

8. The furniture hinge of claim 1, wherein the lever mechanism comprises at least two further levers, which are pivotally hinged to the body-side main element.

9. The furniture hinge of claim 8, wherein the at least two further levers are each mounted on the body-side main element so as to be pivotable about a pivot axis, which is oriented perpendicularly to the pivot axis of the hinge cup.

10. The furniture hinge of claim 8, wherein the at least two further levers each include a toothing and engage in one another via the toothings in such a way that the at least two further levers perform a mirror-image synchronous pivoting movement.

11. The furniture hinge of claim 10, wherein the toothing of each of the at least two further levers is formed by a cylindrical gear arranged on the pivot axis of a respective one of the at least two further levers.

12. The furniture hinge of claim 8, wherein ends each one of the at least two levers is connected to an end of a corresponding one of the at least two further levers at ends in an articulated manner.

13. The furniture hinge of claim 8, wherein a distance between the pivot axes of the at least two further levers is equal to a distance between the pivot axes of the at least two levers.

14. The furniture hinge of claim 1, further comprising:
a damping device configured to damp a closing and/or opening movement, wherein the damping device is a linear damper or rotary damper.

15. The furniture hinge of claim 14, wherein the damping device is coupled, a least temporarily, to at least one lever of the lever mechanism.

16. The furniture hinge of claim 14, wherein the damping device is at least temporarily connected to a toothing of at least one lever of the lever mechanism or the hinge cup.

17. A furniture panel, comprising:
an integrated or inserted furniture hinge, which comprises
a body-side main element; and
a hinge cup, which is pivotally guided relative to the main element and which is securable to a movable furniture part,
wherein the body-side main element and the hinge cup are connected to one another via a lever mechanism,
wherein the lever mechanism comprises at least two levers, each of which is mounted on the hinge cup in a pivotal manner about a pivot axis that is oriented perpendicularly to a pivot axis of the hinge cup and each of which includes a toothing that engages with a further toothing arranged in the hinge cup,
wherein the pivot axes of the at least two levers and the pivot axis of the hinge cup lie between two parallel planes of the furniture panel over an entire range of movement of the movable furniture part, wherein a distance between the two parallel planes corresponding to the width of an end face of the furniture panel.

18. A furniture body, comprising:
a furniture panel, which comprises
an integrated or inserted furniture hinge, which comprises
a body-side main element; and
a hinge cup, which is pivotally guided relative to the main element and which is securable to a movable furniture part,
wherein the body-side main element and the hinge cup are connected to one another via a lever mechanism,
wherein the lever mechanism comprises at least two levers, each of which is mounted on the hinge cup in a pivotal manner about a pivot axis that is oriented perpendicularly to a pivot axis of the hinge cup and each of which includes a toothing that engages with a further toothing arranged in the hinge cup,
wherein the pivot axes of the at least two levers and the pivot axis of the hinge cup lie between two parallel planes of the furniture panel over an entire range of movement of the movable furniture part, wherein a distance between the two parallel planes corresponding to the width of an end face of the furniture panel.

* * * * *